US005180063A

United States Patent [19]

Sakno

[11] Patent Number: 5,180,063

[45] Date of Patent: Jan. 19, 1993

[54] FIRE-STOP SEALANT KIT

[75] Inventor: Michael Sakno, Woodbridge, Canada

[73] Assignee: Instant Firestop Inc., Toronto, Canada

[21] Appl. No.: 792,662

[22] Filed: Nov. 15, 1991

[51] Int. Cl.[5] ..... B65D 69/00

[52] U.S. Cl. ..... 206/582; 206/223; 206/229

[58] Field of Search ..... 206/223, 225, 229, 230, 206/384, 568, 576, 582

[56] References Cited

U.S. PATENT DOCUMENTS

| | | | |
|---|---|---|---|
| 312,756 | 2/1885 | Peck | 206/223 |
| 1,783,453 | 12/1930 | Reisert | 206/576 |
| 2,135,238 | 11/1938 | Malik | 206/225 |
| 2,720,964 | 10/1955 | Hopper | 206/233 |
| 2,789,729 | 4/1957 | Johnson | 206/229 |
| 3,386,568 | 6/1968 | Harmon | 206/225 |
| 3,638,785 | 2/1972 | Casteel et al. | 229/229 |
| 3,682,179 | 8/1972 | Firth et al. | 206/582 |
| 4,024,880 | 5/1977 | Newton et al. | 206/223 |
| 4,119,181 | 10/1978 | Jones | 206/223 |
| 4,212,387 | 7/1980 | Kotski et al. | 206/552 |
| 4,357,961 | 11/1982 | Chick | 206/225 |
| 4,860,888 | 8/1989 | Keith | 206/223 |
| 4,917,238 | 4/1990 | Schumacher | 206/568 |
| 5,092,457 | 3/1992 | Islava et al. | 206/223 |

*Primary Examiner*—David T. Fidei

[57] ABSTRACT

A kit of fire-stop materials contains balanced proportions of sealant and mineral wool. Boxed with tools with a layout that renders transportation and storage convenient, the efficiency of the system makes the package cost effective.

9 Claims, 3 Drawing Sheets

FIRE-STOP SEALANT KIT

FIELD OF THE INVENTION

This invention relates to the packaging of materials used in the sealing of mechanical and electrical services (pipes, cables and conduits, etc.) that pass through floors and walls so as to reduce the spread of fire. More particularly, this invention relates to an assembly of materials suitable to effect installation of a fire-stop barrier, and to the organization of such materials into a kit that is efficient and convenient for both the supplier and the end user.

BACKGROUND TO THE INVENTION

It has become conventional to pack the holes in buildings that are penetrated by mechanical and electrical services with fire-stop materials. This is particularly true where holes for pipes penetrate through concrete floors and walls.

In such cases the holes that are cast or drilled in place are always significantly larger than the pipes that are intended to pass therethrough. This permits small misalignments of the pipes to be accommodated.

The gap between the pipe and perimeter of the hole is then packed with materials to resist the transfer of fire across the fire barrier created by the wall or floor. In the United States a typical industrial standard set for fire-stop materials that perform this function is the test standard ULI 1479 set by Underwriters Laboratories Ltd. Many architects specify for fire-stop materials that meet this standard.

A satisfactory fire-stop arrangement has previously been established using a combination of mineral wool packing and an intumescent silicone sealant (usually a self-levelling, or gun-grade, room temperature vulcanizing-RTV sealant) that is applied as an elastomeric caulk to contain the mineral wool packing and create an air-tight seal. This sealant must bond sufficiently to the pipe and hole to resist washing-out, as where water from fire hoses floods a floor in a building.

Customarily, the silicone sealant has been marketed in extrudable tubes. As such sealants are moisture-curing, they will, once opened, have only a limited lifetime. Since such sealant is an expensive material, it has been found efficient to supply it in multiple, sealed units or tubes of moderate volume.

The mineral wool used for packing is inherently nonflammable. It serves to insulate gaps between pipes and hole perimeters and acts as the fire-stop. The sealant, applied to the top surface of the wool for floor penetrations, and on both sides of the wool for wall penetrations, serves to block smoke and prevent air flow.

In a typical case of a 6 inch diameter hole filled with a 4 inch pipe a gap of approximately one inch will exist around the pipe. The mineral wool is packed into this gap, usually to a required minimum length (extending along the pipe) according to the fire rating that is desired, e.g., a 2 hour rating may require 114 mm or 4½ inches of wool. The gap at the places where the pipe exits the hole is then sealed with the sealant, to a specified depth, typically 6 mm or about one-quarter of an inch, in order to meet the approved standard. The wool should be placed close to the end of the hole to support the sealant and provide a guide to ensure that a proper, minimum depth of sealant is applied.

All fire-stop design listings (Underwriter's Laboratories and Factory Mutual approvals) indicate that specific tested fire-components, when applied according to the prescribed methods, constitute the approved fire-stop system. When sealant and mineral wool are purchased separately, there is no certainty that the approved combination of material will be selected. This invention ensures that the specifically approved combination of fire-stop components to meet such standards are delivered to the end user.

It has been found by the inventor herein that a typical worker can install fire-stop for about 25–30 average floor penetrations in a four hour shift. This consumes around 16 feet of four inch thick, two inch wide, compressible mineral wool batting; and about 6 tubes of 300 ml, (or 10.1 fluid ounces), of silicone caulking.

Workmen on a job site conveniently require as tools for installation of this type of fire-stop:

(1) a caulking gun—to force sealant from the tube;
(2) a knife—to open the sealant tube;
(3) a mask and gloves—for protection; and
(4) a stick—for pressing the mineral wool into place.

Items (3) and (4), to the extent that they have been provided to workmen in the past, have been treated as consumables and are thrown away after a short period of use. Item (2) is often assumed to be provided by the workman, and item (1) has often been considered reusable, although caulking guns are often lost on the job site, as are other tools.

Against this background the inventor has recognized that the delivery and consumption of fire-stop materials can be rendered more convenient and efficient by means of assembly of a specific "kit" of materials, and its delivery in a convenient packaging format.

The invention in its general form will first be described, and then its implementation in terms of specific embodiments will be detailed with reference to the drawings following hereafter. These embodiments are intended to demonstrate the principle of the invention, and the manner of its implementation. The invention will then be further described, and defined, in each of the individual claims which conclude this Specification.

SUMMARY OF THE INVENTION

The invention in its broadest sense consists of a kit of fire stop materials for sealing penetrations through walls or floors, packaged in a single box, comprising:

(1) a supply of mineral wool;
(2) a supply of intumescent sealant; and
(3) at least one tool for installing the sealant in the form of a caulking gun, wherein the amount of sealant in the kit is proportional to the amount of mineral wool in accordance with the respective amounts of such materials to be consumed for each penetration to be sealed. Preferably, in the case of a floor kit, this proportion is in the range of 60 to 90 ounces of sealant for 1500 to 1600 cubic inches of mineral wool in its fully expanded condition. In the case of a wall kit the same preferred proportions would be applied to half as many holes, packing wool and applying sealant from both sides.

More specifically, in a preferred embodiment, the sealant is supplied in the form of six 300 ml (10.1 oz) size tubes of sealant to 16 feet of four inch thick, two inch wide mineral wool batting.

As a preferred embodiment the components of the kit are packed in a box wherein the mineral wool is cut, preferably into eight pieces of 2 inch wide, 4 inch thick and 24 inch long strips arranged centrally within the box, to form a rectangular volume that is bounded by sealant tubes at both ends. Preferably such tubes are symmetrically placed on either side of the mineral wool, and are snugly held between the mineral wool and the box ends to prevent such tubes from being loose within the box. Optionally, the mineral wool may be compacted by vacuum storage in a hermetically sealed outer covering, such as polyethylene film, to reduce the overall volume of the box.

As a further optional but preferred embodiment, the box provides an overhead storage space above the mineral wool. The tool for installing the sealant is placed in such overhead storage space. As a preferred feature, this overhead storage space contains as tools:

(1) a caulking gun—to force sealant from the tube;
(2) a knife—to open the sealant tube;
(3) a mask and gloves—for protection; and
(4) a stick—for pressing the mineral wool into place, optionally embossed with guide marks for determining correct mineral wool placement.

As a further optional feature the mineral wool is surrounded by a cardboard liner that provides a protective wall between the sealant tubes and mineral wool, and extends upwards for the full height of the box to define an inner storage area within the overhead storage space wherein the tool or tools identified above are placed.

As a further optional feature, the box is provided with handle openings that pierce the longitudinal sides of the box and the liner centrally, at a location that is in-line with the overhead storage space.

In summarizing the invention above, and in describing the preferred embodiments below, specific terminology has been resorted to for the sake of clarity. However, the invention is not intended to be limited to the specific terms so selected, and it is to be understood that each specific term includes all technical equivalents which operate in a similar manner to accomplish a similar purpose.

DESCRIPTION OF THE PREFERRED EMBODIMENTS

Figure 1:
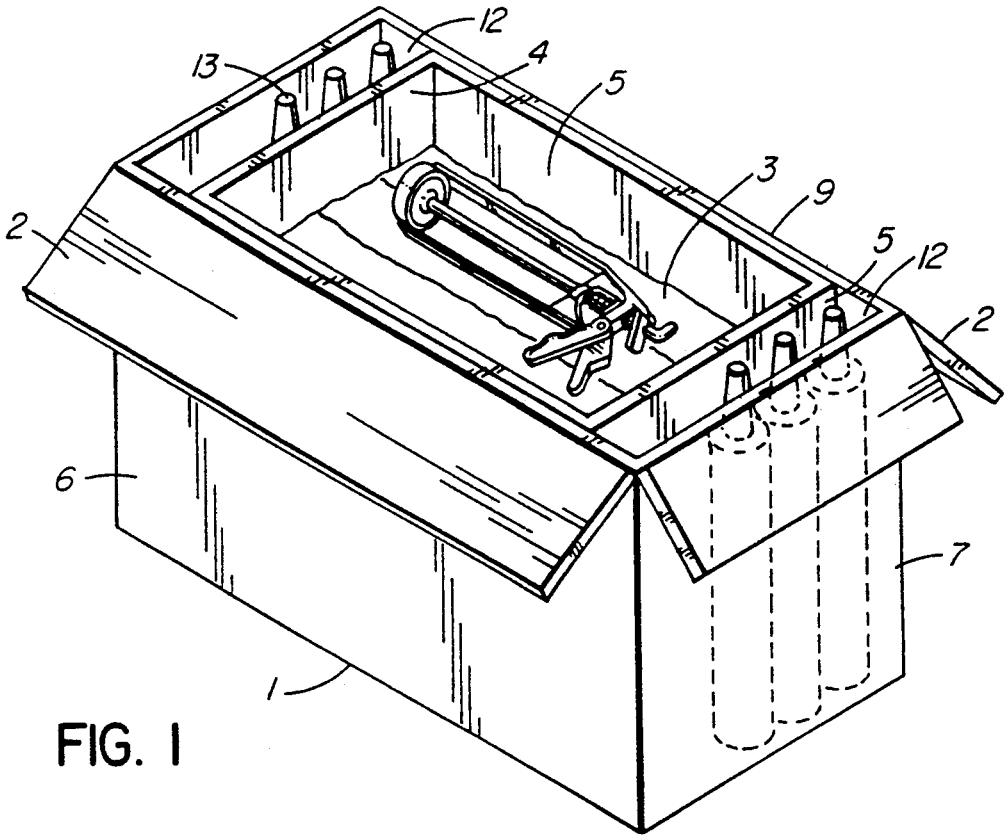
FIG. 1 is a perspective view of a box containing a kit of fire-stop materials.
Figure 2:
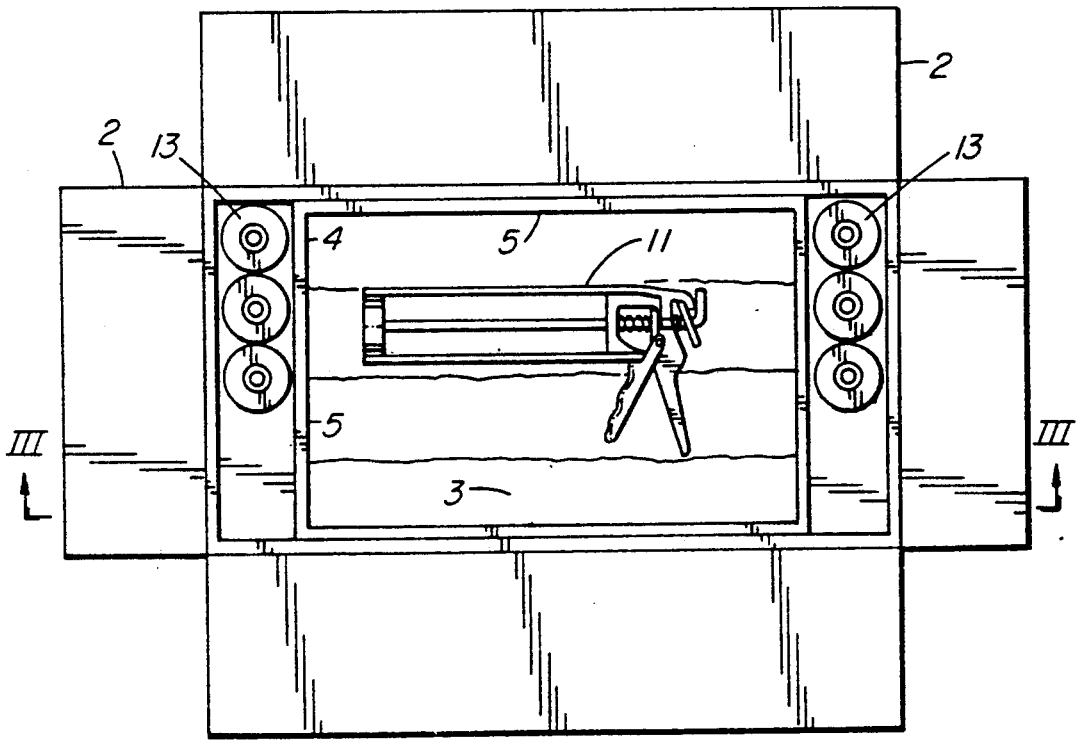
FIG. 2 is a top view of the box of FIG. 1.
Figure 3:
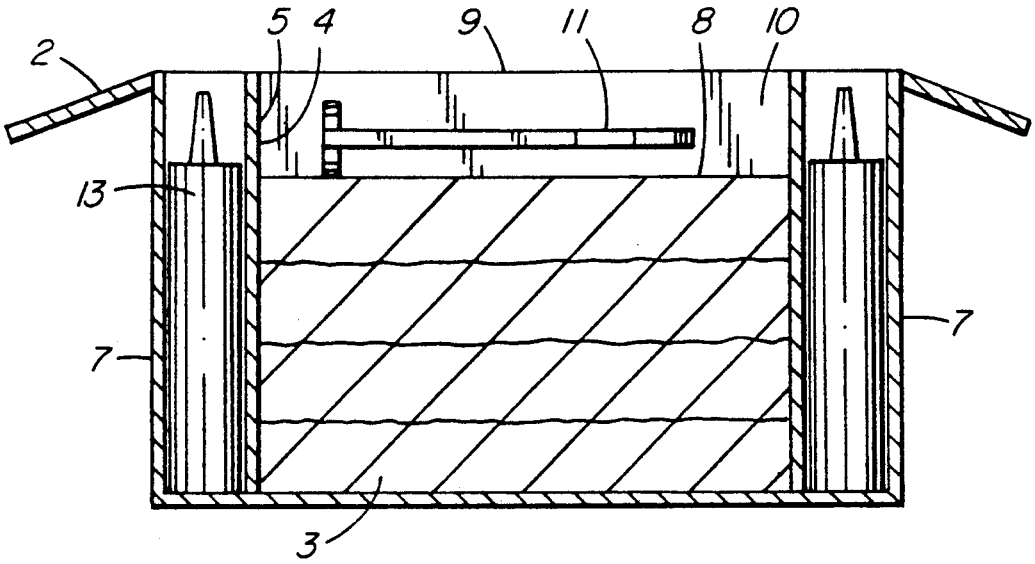
FIG. 3 is a front sectional view of FIG. 3.

In FIG. 1 a box 1 with upper flaps 2 that can close to form a lid contains strips of mineral wool 3. The box 1 is preferably formed with panels of corrugated paperboard. Inside the box 1 is a liner 4 consisting of a rectangular four-sided paperboard wall 5 that encloses the mineral wool 3. The liner 4 is of the same full height as the outer side walls 6 of the box 1. This provides strength to permit boxes to be stacked.

The liner 4 is centrally located between the ends 7 of the box 1. The mineral wool 3 is filled to a level 8 within the box 1 that is short of the upper edge 9 of the box. This forms an inner overhead storage space 10 in which a tool, at minimum a caulking gun", or tools may be placed for storage and delivery.

The liner 4 occupies the full width of the box 1 in one, shorter transverse direction. In the other longer longitudinal direction, the liner 4 defines two symmetrical, compartments 12 located between the box and side walls 7. These compartments 12 contain sealant tubes 13 that are snugly fitted between the liner wall 5 and the box end walls 7. This tight fit prevents the tubes 13 from shifting within the box 1 during transportation. The wall 5 of the liner 4 also protects the mineral wool 3 from being damaged by the shifting of the tubes 13.

Figure 4:
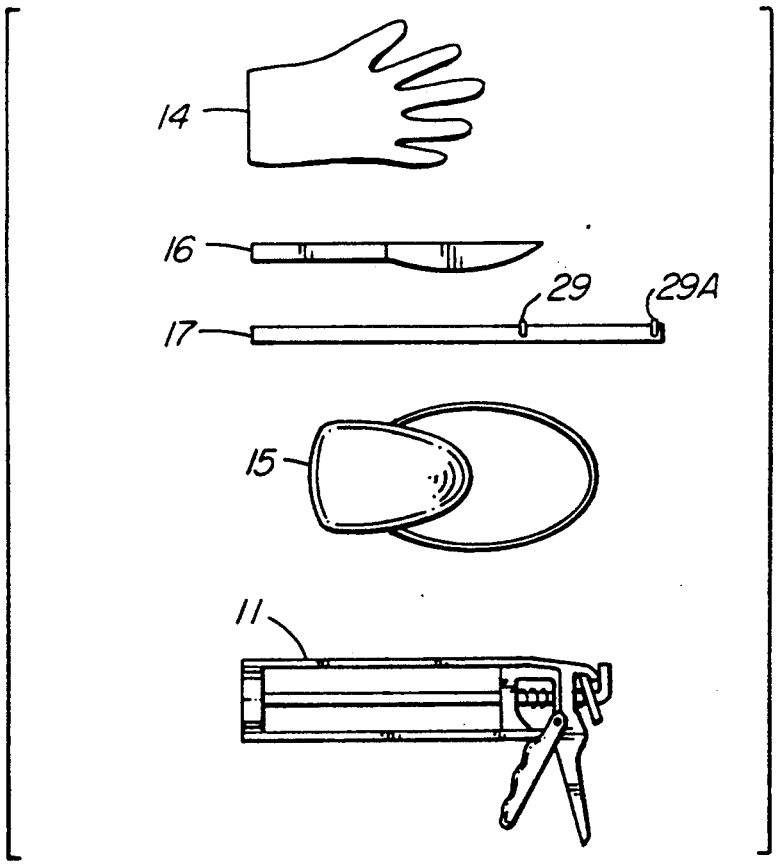
FIG. 4 is an exploded view of the various tools that may be placed in the kit.

A variety of tools may be placed within the inner overhead space 10 inside the box 1. As shown in FIG. 4 these may include gloves 14, a mask 15, a knife 16, a stick 17 and a caulking gun 11. Preferably the gloves 14 are made of an absorbant material, such as cotton, to permit the gloves 14 to be used to wipe and clean surfaces to be sealed by the silicone caulking.

Figure 5:
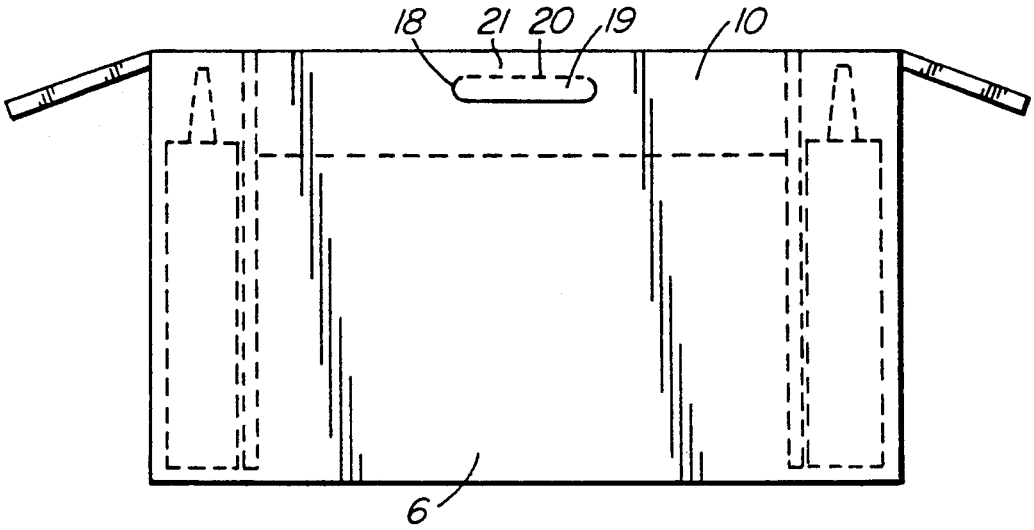
FIG. 5 is a side view of the box showing the placement of openings that serve as handles.

In FIG. 5 handle openings 18 are formed centrally in the two longitudinal side walls 6 at the height of the overhead storage space 10, passing through the wall 5 of the liner 4. These openings 18 are formed by cutting flaps 19 that are folded inwardly along a fold-line 20. The openings 18 may optionally extend through the wall 5 of the liner 4 into the inner, overhead storage space 10, or may pass only through the outer side walls 6 of the box 1. These folded flaps 19 provide a grasping surface for fingers inserted into the handle openings 18. In the case where the flaps extend through the liner, the walls 21 lying above the handle openings 18 are of double thickness and, therefore, are of increased strength, suitable to support the weight of the kit. Where only the outer walls 6 are pierced, the liner 4 blocks fingers inserted in the openings 18 from contacting the mineral wool 3.

Because the tubes 13 are symmetrically placed about the handle openings 18, the box 1 will be balanced when lifted or stacked for storage. As the handle openings 18 penetrate into the head space, when fingers are inserted therein, such fingers will not contact the mineral wool 3.

Figure 6:
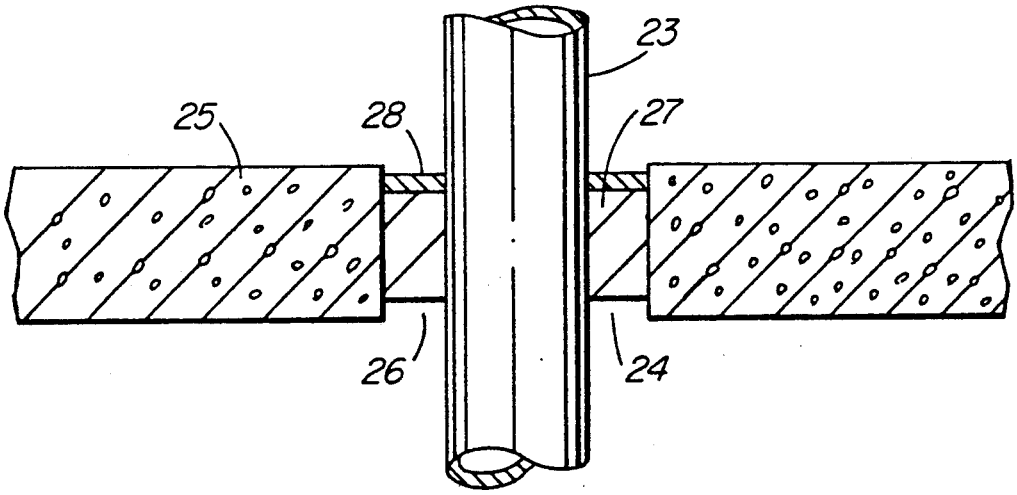
FIG. 6 is a cross-sectional view of a floor pierced by a pipe sealed by mineral wool packing.

In use the materials in a typical floor kit are installed in the conventional manner to meet the predetermined fire retardancy standard. As shown in FIG. 6, a pipe 23 passes through a hole 24 in a concrete floor 25, leaving a gap 26. This gap 26 is filled to a minimum depth, preferably 114 mm or 4 ½ inches for a 4 inch pipe, by mineral wool 27 which is recessed by 12.7 mm or ½ inch from the top of the floor slab. To meet fire retardancy standards, the wool 27 may be required to be compacted to 50% of its non-compacted volume.

A layer of intumescent sealant 28 is laid over the mineral wool 27, to a preferred minimum depth of 6 mm or one-quarter of an inch, leaving a slight recess below the floor to protect the sealant.

The knife 16 is used to cut the mineral wool fibre battings to the correct size. The stick 17 is used to press the wool 27 into place. As a guide to the placement of the mineral wool 27 the stick 17 may be embossed with markers 29, 29*a* that indicate the preferred depths for the bottom and top of the mineral wool 27.

By assembling all of the components, in balanced proportions, and placing them in a box in the manner indicated, a kit is provided that contains all of the components needed by a workman to carry-out a series of fire-stop installations in a normal working period. While a number of components, particularly the tools provided in the kit as throw-away items are normally conserved, it has been found that the convenience and efficiency of the kit justifies this expense.

CONCLUSION

The foregoing has constituted a description of specific embodiments showing how the invention may be applied and put into use. These embodiments are only exemplary. The invention in its broadcast, and more specific aspects, is further described and defined in the claims which now follow.

The embodiments of the invention in which an exclusive property or privilege is claimed are defined as follows:

1. A kit of fire stop materials, for sealing penetrations through walls or floors, packaged in a single box, comprising:

(1) a supply of mineral wool;

(2) a supply of intumescent sealant; and (3) at least one tool for installing the sealant in the form of a caulking gun, wherein the amount of sealant contained within the kit is proportional to the amount of mineral wool, in accordance with the respective amounts of such materials to be consumed for each penetration to be sealed and wherein the mineral wool is placed centrally within the box, to form a rectangular volume that is bounded by multiple sealant tubes at both ends, said tubes being held between the mineral wool and the box ends to prevent such tubes from being loose within the box.

2. A kit as in claim 1 wherein such proportion is in the range of 60 to 90 fluid ounces of sealant for 1500 to 1600 cubic inches of mineral wool in its fully expanded condition.

3. A kit as in claim 1 containing six 300 ml (10.1 oz) size tubes of sealant and 16 feet of four inch thick, two inch wide mineral wool batting.

4. A kit as in claim 1 wherein a mineral wool is compacted by vacuum storage in a hermetically sealed outer covering, such as polyethylene film, to reduce the overall volume of the box.

5. A kit as in claim 1 or 4 wherein the box is provided with an overhead storage space above the mineral wool, and a tool for installing the sealant is placed within such overhead storage space.

6. A kit as in claim 5 wherein the overhead storage space contains as tools:

(1) a caulking gun;

(2) a knife;

(3) a mask and gloves; and (4) a stick.

7. A kit as in claim 6 wherein the stick is embossed with guide marks for determining correct mineral wool placement.

8. A kit as in claim 5 wherein the mineral wool is surrounded by a cardboard liner that provides a protective wall between the sealant tubes and mineral wool, and extends upwards for the full height of the box to define the overhead storage space wherein a tool or tools are placed.

9.. A kit as in claim 8 wherein the box is provided with handle openings that pierce the sides of the box and the liner centrally, at a location that is in-line with the overhead storage space.

* * * * *